US006996879B1

(12) United States Patent
Savicki

(10) Patent No.: US 6,996,879 B1
(45) Date of Patent: Feb. 14, 2006

(54) CLOSURE DEVICE

(75) Inventor: Alan F. Savicki, Oswego, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/049,319

(22) PCT Filed: Jun. 6, 2000

(86) PCT No.: PCT/US00/40117

§ 371 (c)(1),
(2), (4) Date: Feb. 5, 2002

(87) PCT Pub. No.: WO01/94227

PCT Pub. Date: Dec. 13, 2001

(51) Int. Cl.
*A44B 19/16* (2006.01)

(52) U.S. Cl. ..... 24/30.5 R; 24/400; 383/64

(58) Field of Classification Search ..... 24/387, 24/388, 390, 399, 400, 30.5 R; 383/64, 69
See application file for complete search history.

(56) References Cited

U.S. PATENT DOCUMENTS

| | | | | |
|---|---|---|---|---|
| 3,806,998 | A | 4/1974 | Laguerre | 24/201 |
| 5,007,143 | A | 4/1991 | Herrington | |
| 5,020,194 | A * | 6/1991 | Herrington et al. | 24/400 |
| 5,067,208 | A | 11/1991 | Herrington et al. | |
| 5,301,395 | A | 4/1994 | Richardson et al. | |
| 5,664,299 | A | 9/1997 | Porchia | |
| 5,833,791 | A | 11/1998 | Brynaiarski et al. | |
| 5,871,281 | A | 2/1999 | Stolmeier | |
| 6,257,763 | B1 * | 7/2001 | Stolmeier et al. | 383/5 |

FOREIGN PATENT DOCUMENTS

DE 3208245 A1 * 9/1983

* cited by examiner

*Primary Examiner*—James R. Brittain
(74) *Attorney, Agent, or Firm*—Thomas C. Feix

(57) ABSTRACT

The closure device includes interlocking fastening strips and a slider. The fastening strips include a flange portion that engages a separator on the slider. The flange portion angles inwardly toward the separator. The flange portion is altered at the closing end of the fastening strips to prevent the slider from opening the fastening strips a the closing end. The flange portion may be altered by flattening the flange portion.

17 Claims, 8 Drawing Sheets

CLOSURE DEVICE

FIELD OF THE INVENTION

The present invention relates generally to closure devices and, more particularly, to a slider and interlocking fastening strips. The invention is particularly well suited for fastening flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements, which are used to selectively seal the bag. In addition, sliders may be provided for use in opening and closing the fastening strips. The sliders may include a separator which extends at least partially between the fastening strips. If the slider is moved in the opening direction, the separator divides or deoccludes the fastening strips and opens the bag. If the slider is moved in the closing direction, the slider closes or occludes the fastening strips.

When the slider is at the closed end of the bag, the separator is still positioned between the fastening strips and, thus, the fastening strips at the closed end of the bag may not be fully occluded. If the fastening strips are not fully occluded the bag may allow air to enter or the bag may allow the contents of the bag to leak from the bag. These situations are not desirable. The present invention provides a solution to this problem.

SUMMARY OF THE INVENTION

The closure device includes first and second interlocking fastening strips arranged to be to be interlocked over a predetermined length. The closure device additionally includes a slider which is slidably disposed on the interlocking fastening strips for facilitating the occlusion and deocclusion of the fastening strips when moved towards first and second ends of the fastening strips.

The fastening strips include an upper flange portion that engages a separator on the slider. The flange portion angles inwardly toward the separator. The flange portion is altered at the closing end of the fastening strips to prevent the slider from opening the fastening strips at the closing end. The flange portion may be altered by flattening the flange portion.

The present invention will become more readily apparent upon reading the following detailed description of exemplified embodiments and upon reference to the accompanying drawings herein.

DESCRIPTION OF THE EMBODIMENTS

Figure 1:
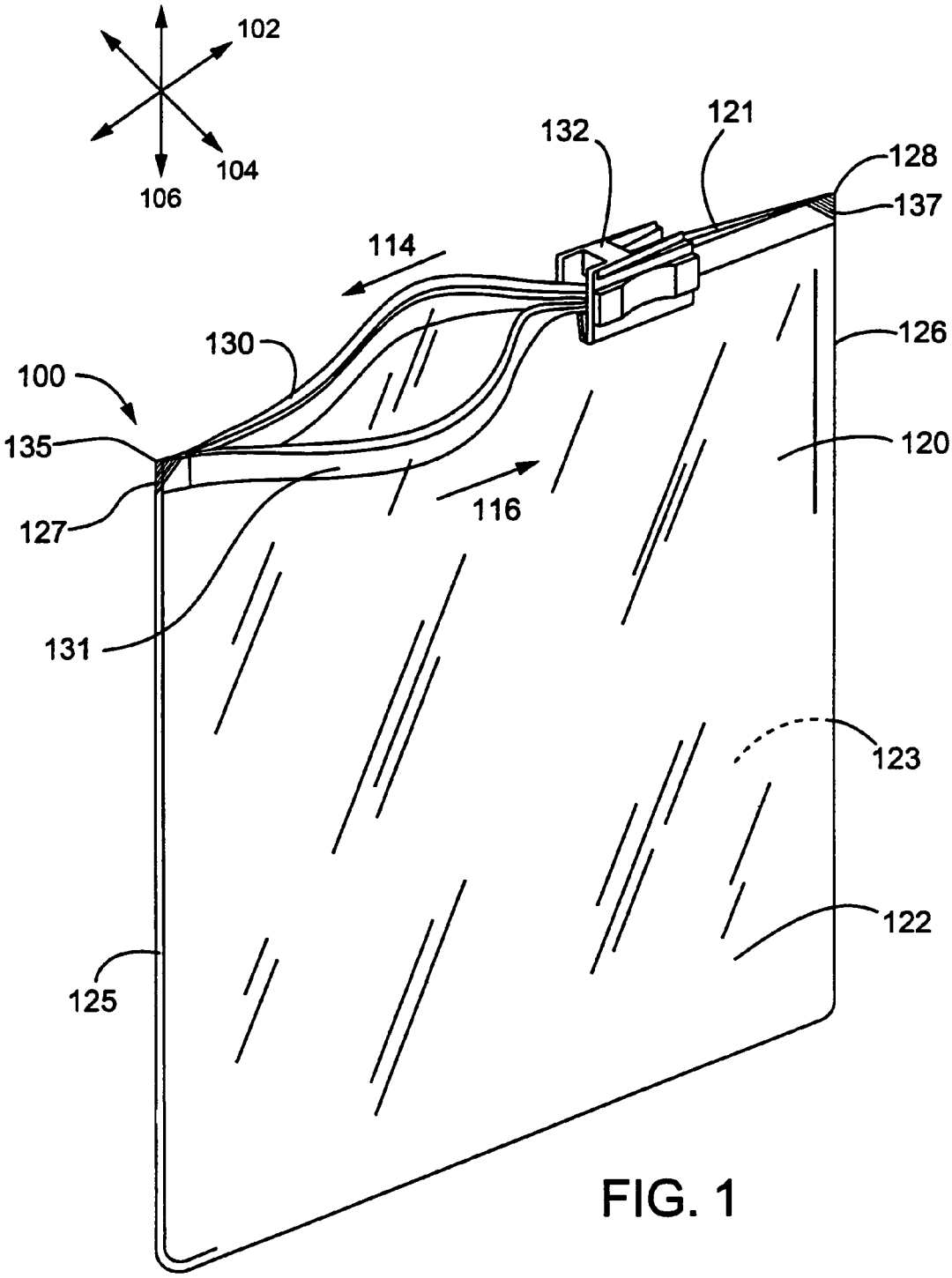
FIG. 1 is a perspective view of a container according to the present invention in the form of a plastic bag.
Figure 2:
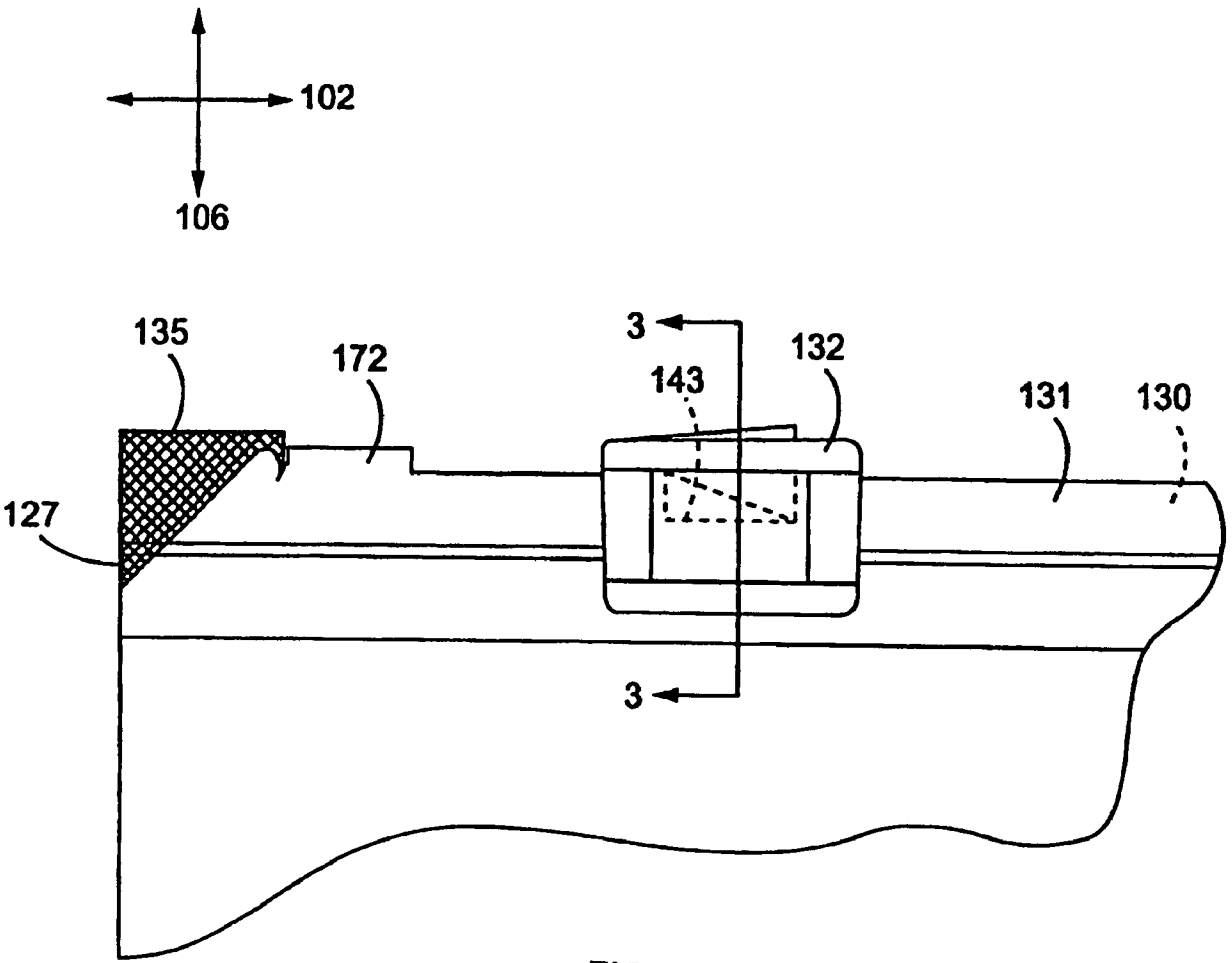
FIG. 2 is a fragmentary side view of the container in FIG. 1.
Figure 3:
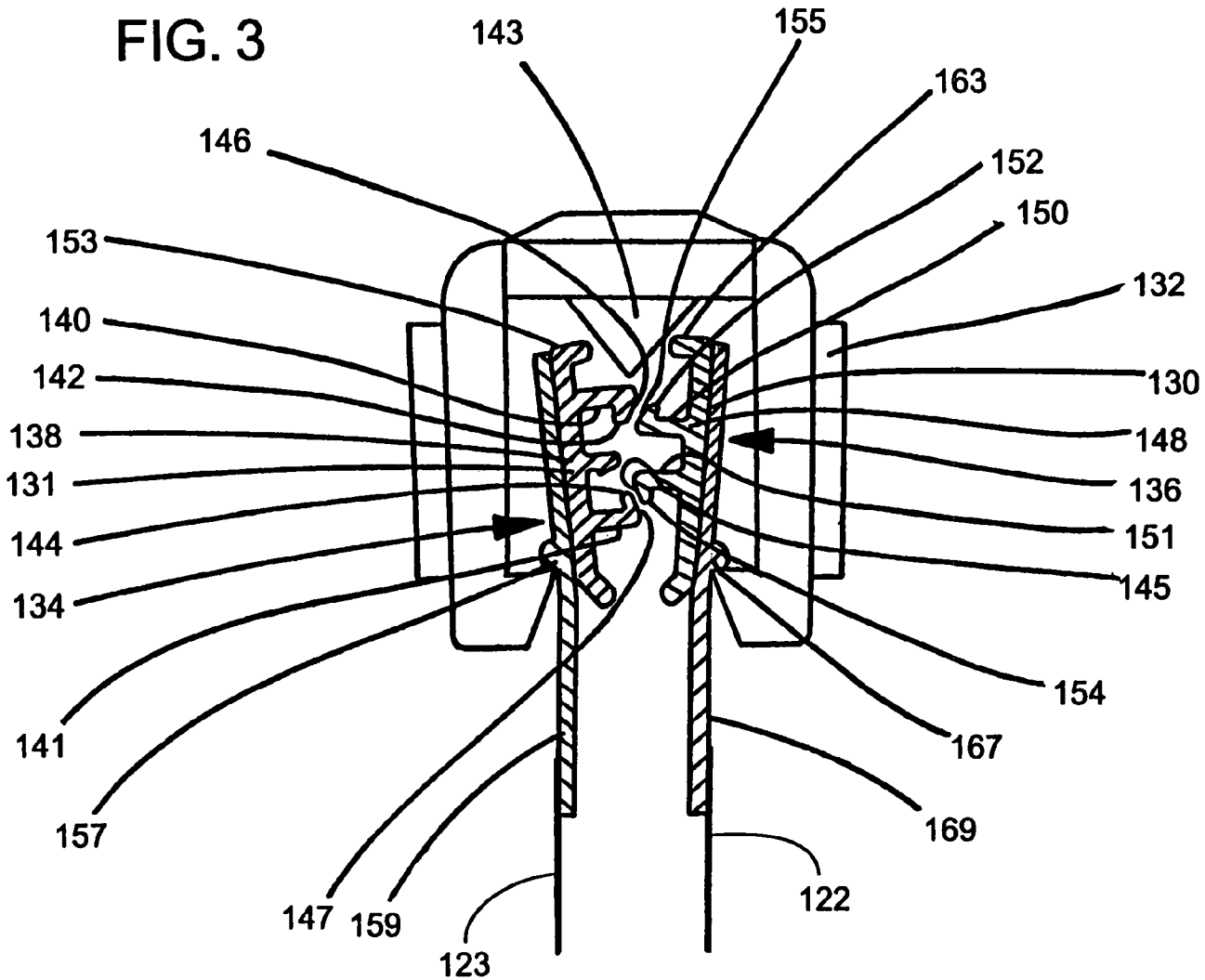
FIG. 3 is a cross-sectional view taken along line 3—3 in FIG. 2.

FIGS. 1–3 illustrate an embodiment of a container in the form of a plastic bag 120 having a sealable closure device 121. The bag 120 includes a first sidewall 122 and a second sidewall 123 joined at seams 125, 126 to define a compartment accessible through the open top end but sealable by means of the closure device 121. The closure device 121 includes first and second fastening strips 130, 131 and a slider 132.

The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The fastening strips 130, 131 are adapted to be interlocked between a first end 127 and a second end 128. The fastening strips 130, 131 are secured together at the first and second ends 127, 128 to form end seals. The first and second ends 127, 128 may include melted portions 135, 137, in which the fastening strips 130, 131 are melted together by heat sealing, ultrasonic sealing or other operation to form the end seals. The first and second ends 127, 128 may alternatively be secured together by plastic clamps, or other means.

The slider 132 is mounted onto the fastening strips 130, 131 so that the slider 132 is restrained from being removed from the fastening strips 130, 131 but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

The first fastening strip 130 includes a first closure element 136. The second fastening strip 131 includes a second closure element 134. The first closure element 136 engages the second closure element 134. The first closure element 136 includes a base portion 148 including a pair of spaced-apart, parallely disposed webs 150, 151 extending from the base portion 148. The base and the webs form a U-channel closure element. The webs 150, 151 include hook closure portions 152, 154 extending from the webs 150, 151 respectively and facing away from each other. The hook closure portions 152, 154 include guide surfaces 145, 155 which generally serve to guide the hook closure portions 152, 154 for occlusion with the hook closure portion 142, 144 of the second closure element 134. The guide surfaces 145, 155 may also have a rounded crown surface. The second closure element 134 includes a base portion 138 having a pair of spaced-apart parallely disposed webs 140, 141, extending from the base portion 138. The base and the webs form a U- channel closure element. The webs 140, include hook closure portions 142, 144 extending from the webs 140, 141 respectively, and facing towards each other. The hook closure portions 142, 144 include guide surfaces 146, 147 which serve to guide the hook closure portions 142, 144 for occluding with the hook closure portions 152, 154 of the first closure element 136.

The first fastening strip 130 includes an upper flange portion 163. The flange portion 163 extends inwardly from the base portion 148. The flange portion 163 may extend from the base portion 148 or the flange portion 163 may extend from the flange 169. The first fastening strip 130 may include a rib 167 disposed at the lower end of the first fastening strip 130. The second fastening strip 131 includes an upper flange portion 153. The flange portion 153 extends inwardly from the base portion 138. The flange portion 153 may extend from the base portion 138 or the flange portion 153 may extend from the flange 159. The second fastening strip 131 may include a rib 157 disposed at the lower end of the second fastening strip 131.

The slider 132 includes a separator 143 having a first end and a second end wherein the first end may be wider than the second end. In addition, the separator 143 may be triangular in shape. When the slider is moved in the occlusion direction, the separator 143 deoccludes the fastening strips 130, 131, as shown in FIG. 3. The separator 143 engages the flange portions 153, 163 and the flange portions 153, 163 move outward in the Y axis 104. This action causes the closure elements 134, 136 to deocclude. In this embodiment, the upper hook portions 142, 152 and the lower hook portions 144, 154 deocclude.

Figure 4:
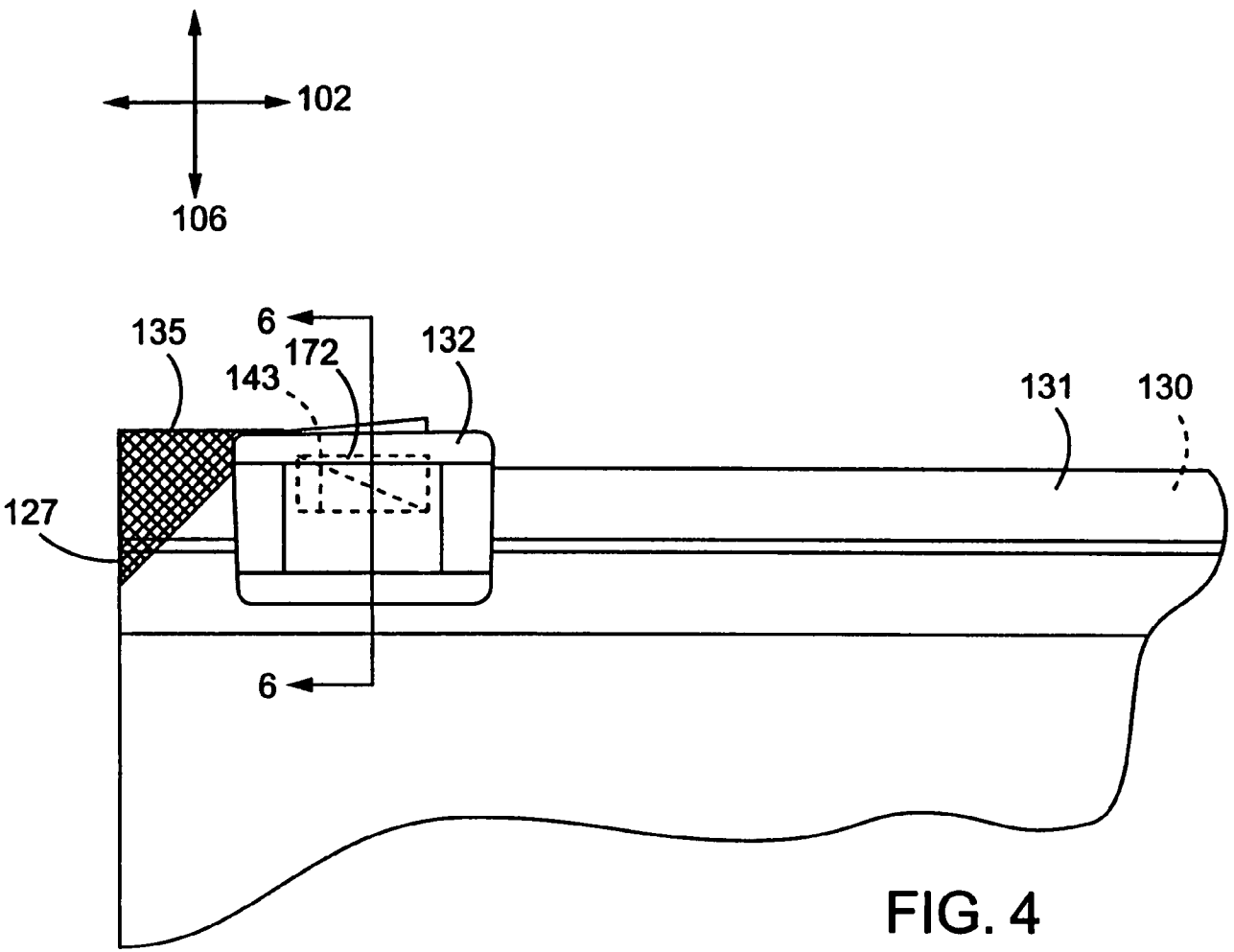
FIG. 4 is a fragmentary side view of the container in FIG. 1 with the slider in another position.
Figure 5:
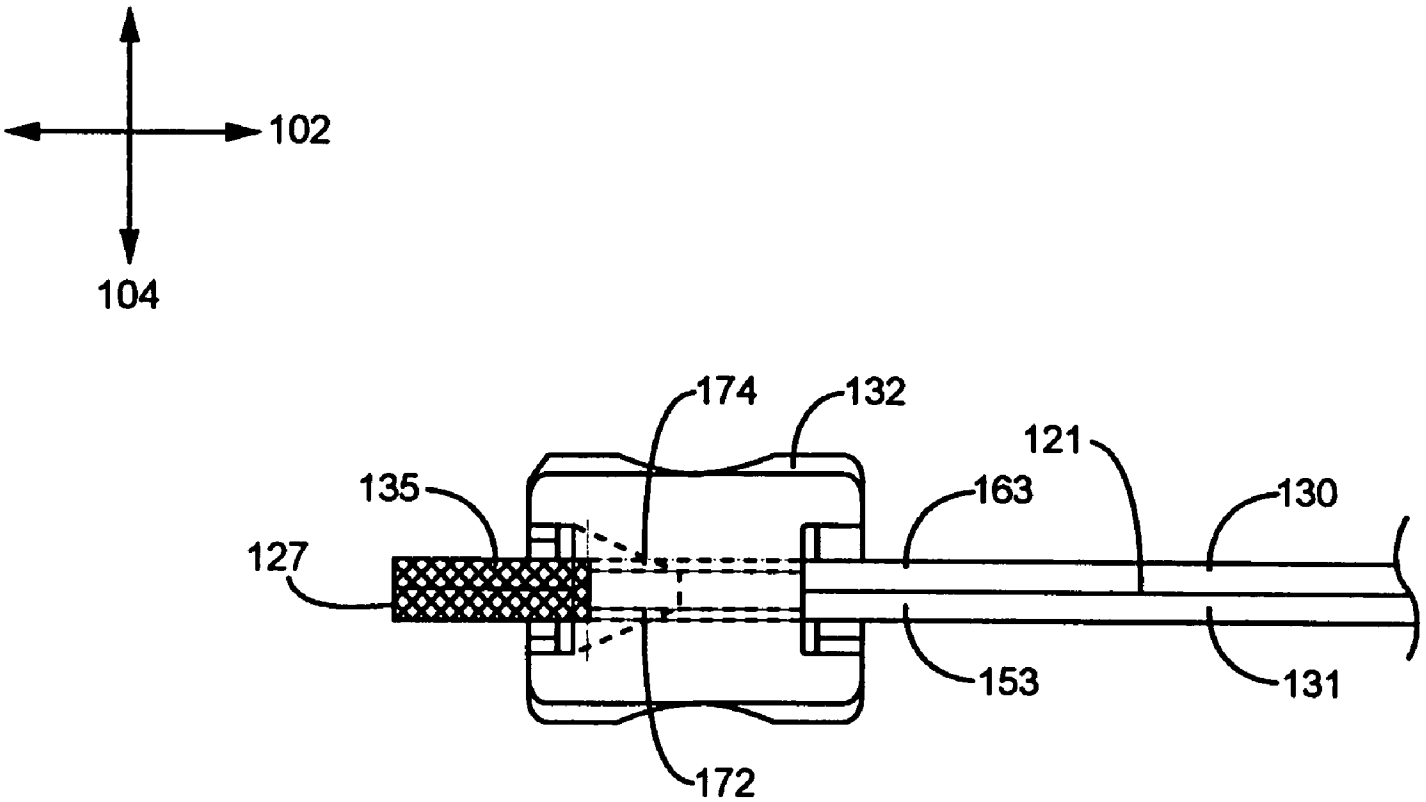
FIG. 5 is a fragmentary top view of the closure device in FIG. 4.
Figure 6:
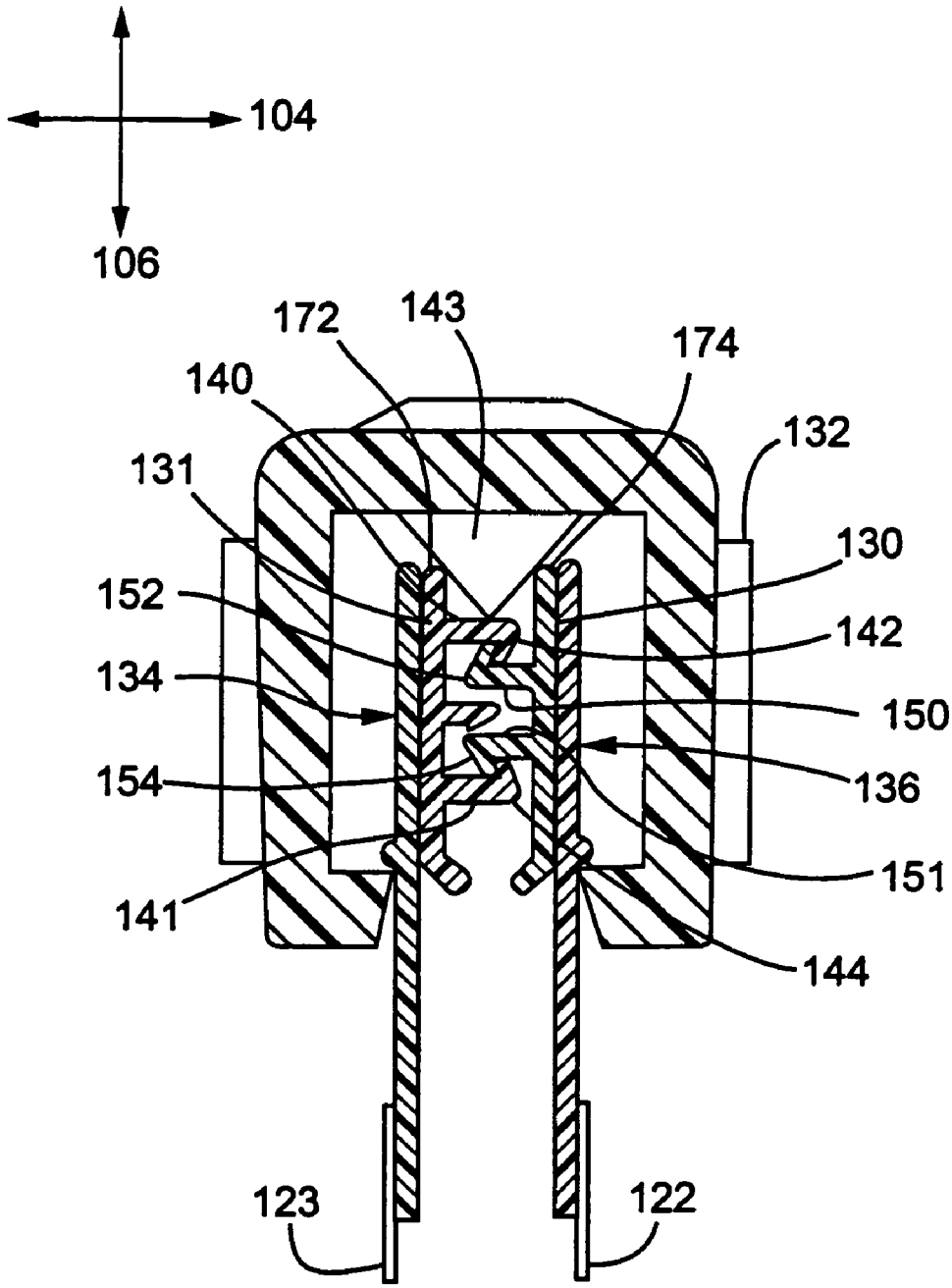
FIG. 6 is a cross-sectional view taken along line 6—6 in FIG. 4.

In accordance with the present invention, and as shown in FIGS. 4-6, the flange portions 153, 163 include altered flange portions 172, 174 near the first end 127 for facilitating the closure of the fastening strips at the first end 127. In this embodiment, the altered flange portions 172, 174 are created by flattening the flange portions 153, 163 near the first end 127. When the flange portions are flattened, the plastic may move upward. In another embodiment, the altered flange portions are created by removing a portion of the flange portion near the first end 127. The altered flange portions 172, 174 prevent the separator 143 from deoccluding the fastening strips near the first end 127. The closure elements 134, 136 remain occluded when the slider is at the first end 127. Specifically, the upper hook portions 142, 152 and the lower hook portions 144, 154 remain occluded when the slider is at the first end 127. The altered flange portions 172, 174 create a discontinuity in the fastening strips 130, 131, which prevents the separator 143 from deoccluding the closure elements 134, 136 on the fastening strips. The altered flange portions 172, 174 do not allow separator 143 to act upon the flange portions in a manner sufficient to separate the closure elements 134, 136. Thus, the closure elements 134, 136 remain occluded a the first end 127.

Figure 7:
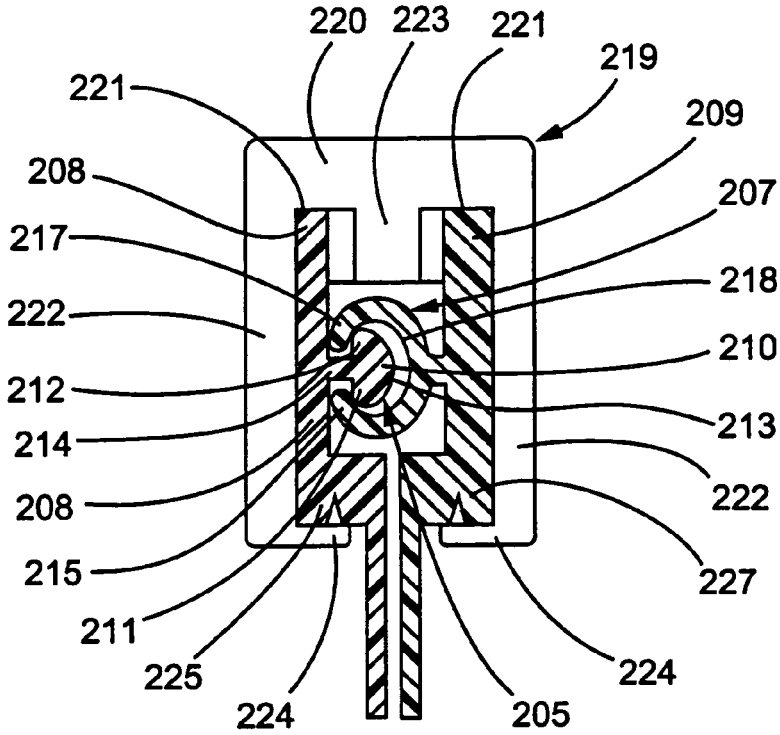
FIG. 7 is a cross-sectional view of another embodiment of the fastening strips.
Figure 8:
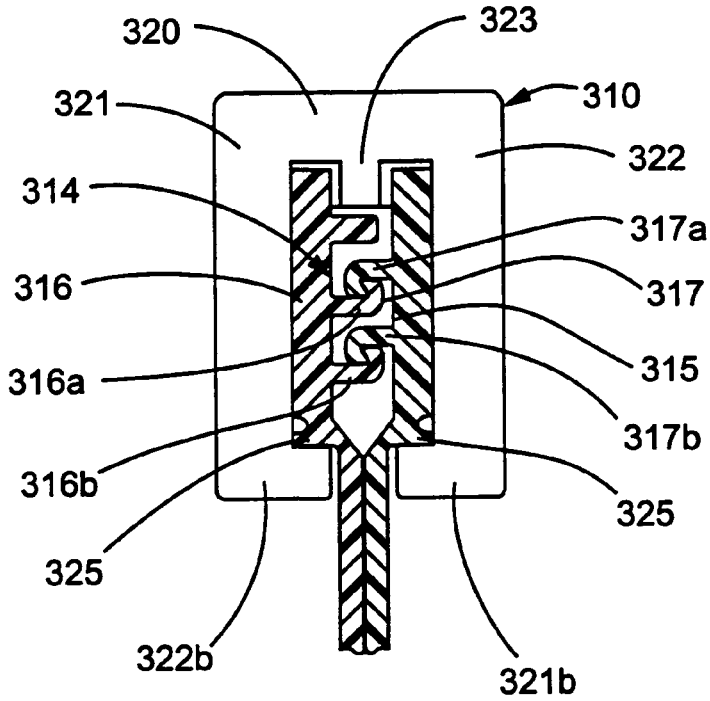
FIG. 8 is a cross-sectional view of another embodiment of the fastening strips.
Figure 9:
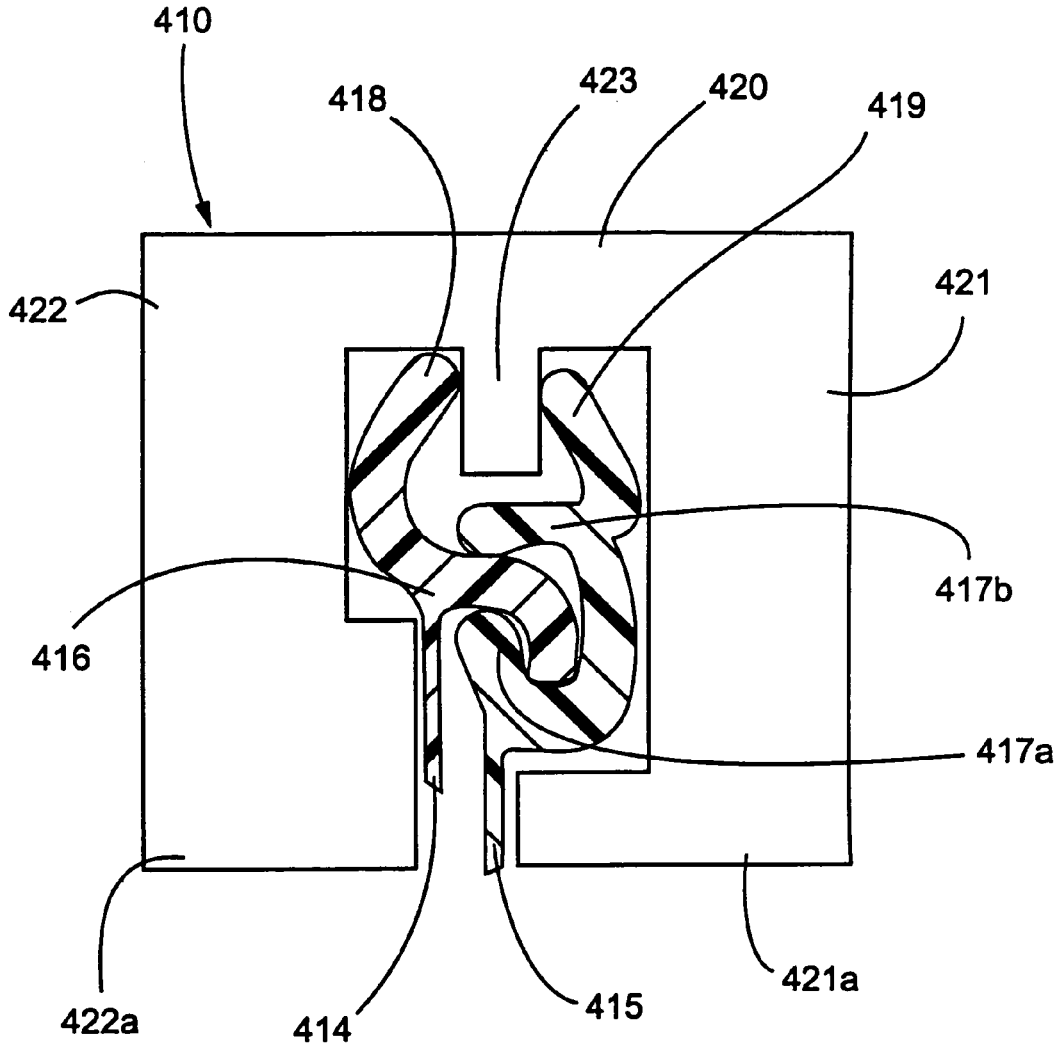
FIG. 9 is a cross-sectional view of another embodiment of the fastening strips.

The altered flange portion or portions may be used on other fastening strips. FIGS. 7-9 illustrate interlocking fastening strips of different configurations with a slider.

The interlocking fastening strips may comprise "arrow-head- type" or "rib and groove" fastening strips as shown in FIG. 7 and as described in U.S. Pat. No. 3,806,998. The rib element 205 interlocks with the groove element 207. The rib element 205 is of generally arrow-shape in transverse cross section including a head 210 comprising interlock shoulder hook portions 211 and 212 generally convergently related to provide a cam ridge 213 generally aligned with a stem flange 214 by which the head is connected in spaced relation with respect to the supporting flange portion 208. (U.S. Pat. No. 3,806,998, Col. 2, lines 16–23). At their surfaces nearest the connecting stem flange 214, the shoulder portions 211 and 212 define reentrant angles therewith providing interlock hooks engageable with interlock hook flanges 215 and 217 respectively of the groove element 207. (U.S. Pat. No. 3,806,998, Col. 2, lines 23–28). Said hook flanges generally converge toward one another and are spread open to receive the head 210 therebetween when said head is pressed into said groove element 207 until the head is fully received in a groove 218 of said groove element 207 generally complementary to the head and within which the head is interlocked by interengagement of the head shoulder hook portions 211 and 212 and the groove hook flanges 215 and 217. (U.S. Pat. No. 3,806,998, Col. 2, lines 28–36). Through this arrangement, as indicated, the head and groove elements 205 and 207 are adapted to be interlockingly engaged by being pressed together and to be separated when forcably pulled apart, as by means of a generally U-shaped slider 219. (U.S. Pat. No. 3,806,998, Col. 2, lines 36–41).

The slider 219 includes a flat back plate 220 adapted to run along free edges 221 on the upper ends of the sections of the flange portions 208 and 209 as shown in the drawing. (U.S. Pat. No. 3,806,998, Col. 2, lines 41–46). Integrally formed with the back plate 220 and extending in the same direction (downwardly as shown) therefrom are respective coextensive side walls 222 with an intermediate spreader finger 223 extending in the same direction as the side walls at one end of the slider. (U.S. Pat. No. 3,806,998, Col. 2, lines 46–51). The side walls 222 are in the form of panels which are laterally divergent from a narrower end of the slider. (U.S. Pat. No. 3,806,998, Col. 2, lines 51–55). The slider walls 222 are each provided with an inwardly projecting shoulder structure 224 flange adapted to engage respective shoulder ribs 225 and 227 on respectively outer sides of the lower section of the flange portions 208 and 209. (U.S. Pat. No. 3,806,998, Col. 2, line 66 to Co. 3, line 3).

In accordance with the invention, the fastening strips may include flange(s) as noted above and the flange(s) are shown altered in FIG. 7.

Additionally, the interlocking fastening strips may comprise "profile" fastening strips, as shown in FIG. 8 and described in U.S. Pat. No. 5,664,299. As shown in FIG. 8, the first profile 316 has at least an uppermost closure element 316*a* and a bottommost closure element 316*b*. (U.S. Pat. No. 5,664,299, Col. 3, lines 25–27). The closure elements 316*a* and 316*b* project laterally from the inner surface of strip 314. (U.S. Pat. No. 5,664,299, Col. 3, lines 27–28). Likewise, the second profile 317 has at least an uppermost closure element 317*a* and a bottommost closure element 317*b*. (U.S. Pat. No. 5,664,299, Col. 3, lines 28–30). The closure elements 317*a* and 317*b* project laterally from the inner surface of strip 315. (U.S. Pat. No. 5,664,299, Col. 3, lines 30–32). When the bag is closed, the closure elements of profile 316 interlock with the corresponding closure elements of profile 317. (U.S. Pat. No. 5,664,299, Col. 3, lines 32–34). As shown in FIG. 8, closure elements 316*a*, 316*b*, 317*a* and 317*b* have hooks on the ends of the closure elements, so that the profiles remain interlocked when the bag is closed, thereby forming a seal. (U.S. Pat. No. 5,664,299, Col. 3, lines 34–37).

The straddling slider 310 comprises an inverted U-shaped member having a top 320 for moving along the top edges of the strips 314 and 315. (U.S. Pat. No. 5,664,299, Col. 4, lines 1–3). The slider 310 has side walls 321 and 322 depending from the top 320. (U.S. Pat. No. 5,664,299, Col. 4, lines 3–4). A separating leg 323 depends from the top 320 between the side walls 321 and 322 and is located between the uppermost closure elements 316*a* and 317*a* of profiles 316 and 317. (U.S. Pat. No. 5,664,299, Col. 4, lines 26–30). The fastening assembly includes ridges 325 on the outer surfaces of the fastening strips 314 and 315, and shoulders 321*b* and 322*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 325. (U.S. Pat. No. 5,664,299, Col. 5, lines 4–7).

In accordance with the invention, the fastening strips may include flange(s) as noted above and the flange(s) are shown altered in FIG. 8.

Also, the interlocking fastening strips may be "rolling action" fastening strips as shown in FIG. 9 and described in U.S. Pat. No. 5,007,143. The strips 414 and 415 include profiled tracks 418 and 419 extending along the length thereof parallel to the rib and groove elements 416 and 417 and the rib and groove elements 416, 417 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 416 is hook shaped and projects from the inner face of strip 414. (U.S. Pat. No. 5,007,143, Col. 5, lines 1–3). The groove element 417 includes a lower hook-shaped projection 417*a* and a relatively straight projection 417*b* which extend from the inner face of strip 415. (U.S. Pat. No. 5,007,143, Col. 5, lines 3–6). The profiled tracks 418 and 419 are inclined inwardly toward each other from their respective strips 414 and 415. (U.S. Pat. No. 5,007,143, Col. 5, lines 6–8).

The straddling slider 410 comprises an inverted U-shaped plastic member having a back 420 for moving along the top edges of the tracks 418 and 419 with side walls 421 and 422 depending therefrom for cooperating with the tracks and extending from an opening end of the slider to a closing end. (U.S. Pat. No. 5,007,143, Col. 5, lines 26–31). A separator finger 423 depends from the back 420 between the side walls 421 and 422 and is inserted between the inclined tracks 418 and 419. (U.S. Pat. No. 5,007,143, Col. 5, lines 34–36). The slider 410 has shoulders 421*a* and 422*a* projecting inwardly from the depending side walls 421 and 422 which are shaped throughout the length thereof for cooperation with the depending separator finger 423 in creating the rolling action in opening and closing the reclosable interlocking rib and groove profile elements 416 and 417. (U.S. Pat. No. 5,007, 143, Col. 5, lines 43–49).

In accordance with the invention, track 418 and/or track 419 would be altered near the closing end of the fastening strips.

Although several interlocking fastening strip embodiments have been specifically described and illustrated herein, it will be readily appreciated by those skilled in the art that other kinds, types, or forms of fastening strips may be used without departing from the scope or spirit of the present invention.

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. For example, the fastening strips may be made from low density polyethylene.

When the fastening strips are used in a sealable bag, the fastening strips and the films that form the body of the bag may be manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag.

The alteration of the upper flange portions may be formed using rollers which flatten the material.

The fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips may be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device, comprising:

first and second interlocking fastening strips arranged to be interlocked over a predetermined longitudinal x axis between first and second ends, the fastening strips being secured together at the first and second ends, said fastening strips having a transverse y axis and a vertical z axis, said transverse y axis being perpendicular to said longitudinal x axis, said vertical z axis being perpendicular to said longitudinal x axis, said vertical z axis being perpendicular to said transverse y axis;

a slider slidably disposed on the fastening strips for movement between the first and second ends, the slider facilitating occlusion of the fastening strips when moved towards the first end, the slider including a separator for facilitating the deocclusion of the fastening strips when the slider is moved towards the second end;

the first fastening strip includes a first upper flange portion having a first length which extends upward generally along said vertical z axis and a second length which extends inward generally along said transverse y axis toward the second fastening strip, said first length of said first upper flange portion is a constant length while being continuous and spanning the entire longitudinal x axis of said first fastening strip, said second length of said first upper flange portion includes a first altered flange portion of reduced inward extension disposed near the first end of the first fastening strip.

2. The invention as in claim 1 wherein the first fastening strip includes a first closure element, the first upper flange portion is located above the first closure element.

3. The invention as in claim 1 wherein the separator engages the second length of the first upper flange portion.

4. The invention as in claim 3 wherein the separator engages the second length of the first upper flange portion to facilitate deocclusion of the fastening strips and wherein the first altered flange portion prevents the separator from acting upon the first upper flange portion in a manner sufficient to separate the fastening strips.

5. The invention as in claim 1 wherein the first altered flange portion is formed by flattening the material of said second length of the first upper flange portion.

6. The invention as in claim 5 wherein the first altered flange portion extends upward after flattening the material of said second length of the first upper flange portion.

7. The invention as claim 1 wherein the first altered flange portion is formed by removing the material of said second length of the first upper flange portion.

8. The invention as in claim 2 wherein the first upper flange portion is formed separately from the first closure element, the first upper flange portion is then joined to the first closure element.

9. The invention as in claim 1 wherein the second fastening strip includes a second upper flange portion having a first length which extends upward generally along said vertical z axis and a second length which extends inward generally along said transverse y axis toward the first fastening strip, a second altered flange portion disposed in said second length of said second upper flange portion immediately adjacent to the first end of the fastening strips, said first and second altered flange portions prevent the separator from acting upon the respective first and second upper flange portions in a manner sufficient to separate the fastening strips.

10. The invention as in claim 9 wherein the first altered flange portion is formed by flattening the material of said second length of the first upper flange portion, the second altered flange portion is formed by flattening the material of said second length of the second upper flange portion.

11. The invention as in claim 9 wherein the first fastening strip includes a first closure element, the first closure element is a U-channel closure element, the second fastening strip includes a second closure element, the second closure element is a U-channel closure element.

12. The invention as in claim 1 wherein the fastening strips are U-channel fastening strips.

13. The invention as in claim 1 wherein the fastening strips are arrowhead type fastening strips.

14. The invention as in claim 1 wherein the fastening strips are profile type fastening strips.

15. The invention as in claim 1 wherein the fastening strips are rolling action type fastening strips.

16. A container comprising:

first and second sidewalls to form a compartment with an opening;

first and second interlocking fastening strips respectively connected to the first and second sidewalls at the opening, the fastening strips being arranged to be interlocked over a predetermined longitudinal x axis between the first and second ends, the fastening strips being secured together at the first and second ends, said fastening strips having a transverse y axis and a vertical z axis, said transverse y axis being perpendicular to said longitudinal x axis, said vertical z axis being perpendicular to said longitudinal x axis, said vertical z axis being perpendicular to said transverse y axis;

a slider slidably disposed on the fastening strips for movement between the first and second ends, the slider facilitating occlusion of the fastening strips when moved towards the first end, the slider including a separator for facilitating the deocclusion of the fastening strips when moved towards the second end;

the first fastening strip includes a first upper flange portion having a first length which extends upward generally along said vertical z axis and a second length which extends inward generally along said transverse y axis toward the second fastening strip, said first length of said first upper flange portion is a constant length while being continuous and spanning the entire longitudinal x axis of said first fastening strip, said second length of said first upper flange portion includes a first altered flange portion of reduced inward extension disposed near the first end of the first fastening strip.

17. A method of manufacturing a closure device, comprising:

providing first and second interlocking fastening strips arranged to be interlocked over a predetermined X axis between first and second ends, the fastening strips being secured together at the first and second ends;

providing a slider slidably disposed on the fastening strips for movement between the first and second ends the slider facilitating occlusion of the fastening strips when moved towards the first end, the slider including a separator for facilitating the deocclusion of the fastening strips when the slider is moved towards the second end; and providing the first fastening strip with a first upper flange portion having a first length which extends upward generally along said vertical z axis and a second length which extends inward generally along said transverse y axis toward the second fastening strip, said first length of said first upper flange portion is a constant length while being continuous and spanning the entire longitudinal x axis of said first fastening strip, said second length of said first upper flange portion includes a first altered flange portion of reduced inward extension disposed near the first end of the first fastening strip.

* * * * *